US005984203A

United States Patent [19]

Rosenberg

[11] Patent Number: 5,984,203

[45] Date of Patent: Nov. 16, 1999

[54] ROTARY WATER SPRINKLER

[76] Inventor: Peretz Rosenberg, Moshav Beit Shearim, 30 046 Doar Na Ha'amakim, Israel

[21] Appl. No.: 09/050,920

[22] Filed: Mar. 31, 1998

[30] Foreign Application Priority Data

Apr. 6, 1997 [IL] Israel ..... 120611

[51] Int. Cl.[6] ..... B05B 3/04; B05B 3/08

[52] U.S. Cl. ..... 239/222.11; 239/222.13; 239/222.15; 239/222.17; 239/230; 239/231; 239/233; 239/237; 239/240; 239/241; 239/263

[58] Field of Search ..... 239/222, 222.11, 239/222.13, 222.15, 222.17, 225.1, 230, 231, 233, 237, 240, 241, 263

[56] References Cited

U.S. PATENT DOCUMENTS

| | | | |
|---|---|---|---|
| Re. 25,942 | 12/1965 | Reynolds | 239/241 X |
| 3,131,867 | 5/1964 | Miller et al. | 239/240 X |
| 3,334,817 | 8/1967 | Miller et al. . | |
| 3,602,431 | 8/1971 | Lockwood | 239/230 X |
| 3,627,205 | 12/1971 | Healy | 239/241 X |
| 3,874,588 | 4/1975 | Flynn | 239/230 X |
| 3,930,618 | 1/1976 | Lockwood | 239/230 |
| 4,625,914 | 12/1986 | Sexton et al. | 239/241 X |
| 4,784,325 | 11/1988 | Walker et al. | 239/204 |
| 4,944,456 | 7/1990 | Zakai | 239/222.19 |

*Primary Examiner*—Andres Kashnikow
*Assistant Examiner*—Robin O. Evans
*Attorney, Agent, or Firm*—Benjamin J. Barish

[57] ABSTRACT

A rotary sprinkler including a water discharge assembly having a water discharge outlet for discharging water laterally of the sprinkler, and a connecting passageway fluidly coupling the inlet to the water discharge outlet. The water discharge assembly is rotated by a drive including a rotary turbine in the connecting passageway rotated by the water flow therethrough, and a ball carried by the rotary turbine and movable radially outwardly thereof by centrifugal force during the rotation of the rotary turbine. An abutment is located to be impacted by the ball when in its radial outward position during the rotation of the rotary turbine to thereby rotate the water discharge assembly in a series of stepped increments.

18 Claims, 2 Drawing Sheets

ROTARY WATER SPRINKLER

FIELD AND BACKGROUND OF THE INVENTION

The present invention relates to rotary sprinklers, and particularly to ball-type rotary sprinklers in which the sprinkler is rotated in a series of stepped increments by impacting one or more balls against an abutment carried by the sprinkler.

The conventional ball-type rotary sprinklers generally include a swirl chamber containing one or more balls which are driven around the chamber by the water flowing from the sprinkler inlet to the sprinkler outlet to produce the impacts rotating the sprinkler. Since in such a sprinkler the ball is in the flowpath of the water, the ball imposes a resistance to the flow of the water through the sprinkler. Moreover, dirt within the water may settle in the swirl chamber and/or on the ball, thereby making the sprinkler susceptible to jamming.

OBJECTS AND BRIEF SUMMARY OF THE INVENTION

An object of the present invention is to provide a ball-type rotary sprinkler of a novel construction having advantages over the conventional ball-type sprinker in the above respects. Another object of the invention is to provide a rotary sprinkler of a simple and compact construction requiring relatively few simple parts which can be produced and assembled in volume and at low cost.

According to the present invention, there is provided a rotary sprinkler, comprising: a mounting member having an inlet connectible to a water supply pipe supplying pressurized water; a water discharge assembly rotatably carried by the mounting member, the water discharge assembly including at least one water discharge outlet for discharging water laterally of the sprinkler, and a connecting passageway fluidly coupling the inlet to the water discharge outlet; and a drive for rotating the water discharge assembly, the drive including a rotary turbine in the connecting passageway rotated by the water flow therethrough from the inlet to the water discharge outlet. The rotary turbine includes vanes located at the end of the connecting passageway adjacent to and in alignment with the water discharge outlet and the end of the connecting passageway such that the vanes break up the water flow into the water discharge outlet to produce a scattered discharge therefrom.

In addition, at least one ball is carried by the rotary turbine and movable radially outwardly thereof by centrifugal force during the rotation of the rotary turbine. The water discharge assembly further includes an abutment located to be impacted by the ball when in its radial outward position during the rotation of the rotary turbine to thereby rotate the water discharge assembly in a series of stepped increments during the rotation of the rotary turbine.

It will thus be seen that in a rotary sprinkler constructed in accordance with the foregoing features, the water flowing through the sprinkler from the inlet to its outlet does not pass through a swirl chamber, or come into direct contact with the ball (or balls) producing the stepped rotation of the sprinkler, and therefore the ball does not impose a resistance to the flow of water through the sprinkler. Moreover, such a sprinkler is less sensitive to jamming by dirt in the supply water.

In addition, such a scattered discharge, rather than a jet discharge, is highly desirable in many applications of rotary sprinklers.

As will also be described below, a sprinkler constructed in accordance with the foregoing features requires but a few simple parts which can be produced and assembled in volume and at low cost.

Further features and advantages of the invention will be apparent from the description below.

BRIEF DESCRIPTION OF THE DRAWINGS

The invention is herein described, by way of example only, with reference to the accompanying drawings, wherein.

DESCRIPTION OF A PREFERRED EMBODIMENT

Figure 1:
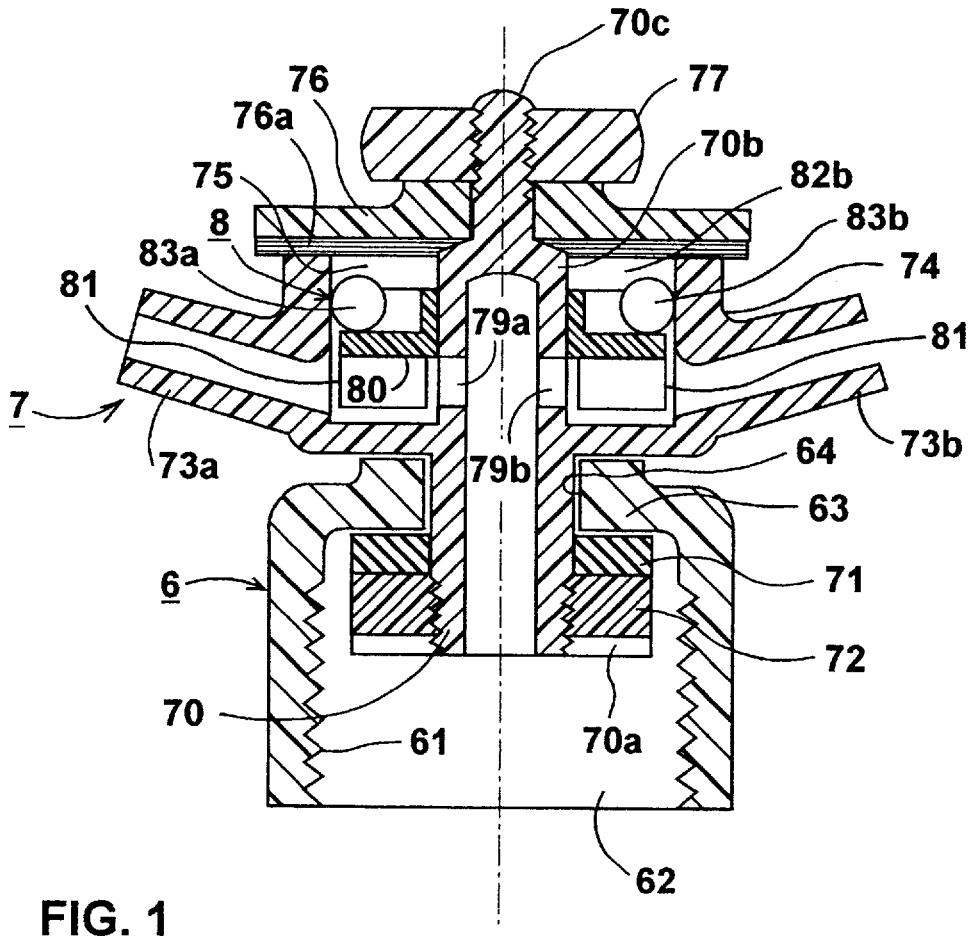
FIG. 1 is a longitudinal sectional view illustrating one form of rotary sprinkler constructed in accordance with the present invention.

The rotary sprinkler illustrated in the drawings comprises three main components: a mounting member, generally designated 6 mountable to a water supply pipe (not shown) supplying pressurized water; a water discharge assembly, generally designated 7, rotatably carried by mounting member 6; and a drive, generally designated 8, for rotating the water discharge assembly 7.

Mounting member 6 is of cylindrical configuration and is formed with internal threads 61 for mounting the water sprinkler to a water supply pipe, such as a vertical riser pipe, supplying pressurized water to the sprinkler. One end of mounting member 6 is open and serves as the inlet 62 to the water sprinkler. The opposite end of mounting member 6 is closed by an end wall 63 formed with a central opening 64 for rotatably mounting the water discharge assembly 7.

The water discharge assembly 7 includes a hollow stem 70 received within opening 64 of the mounting member 6. The inner end 70*a* of stem 70 is sealed with respect to mounting member 6 by means of sealing ring 71 secured to the stem by a washer 72. The outer end 70*b* of stem 70 is integrally formed with a pair of diametrically-aligned water discharge nozzles 73*a*, 73*b* for discharging the water laterally of the sprinkler. Hollow stem 70 is further integrally formed with an annular wall 74 around the outer end of the stem and defining an annular chamber 75. Chamber 75 is closed by a cover 76 secured to the outer tip 70*c* of stem 70 by a locking ring 77. A sealing ring 76*a* is interposed between the annular wall 74 and cover 76 to sealingly close chamber 75 when the cover is applied.

Figure 2:
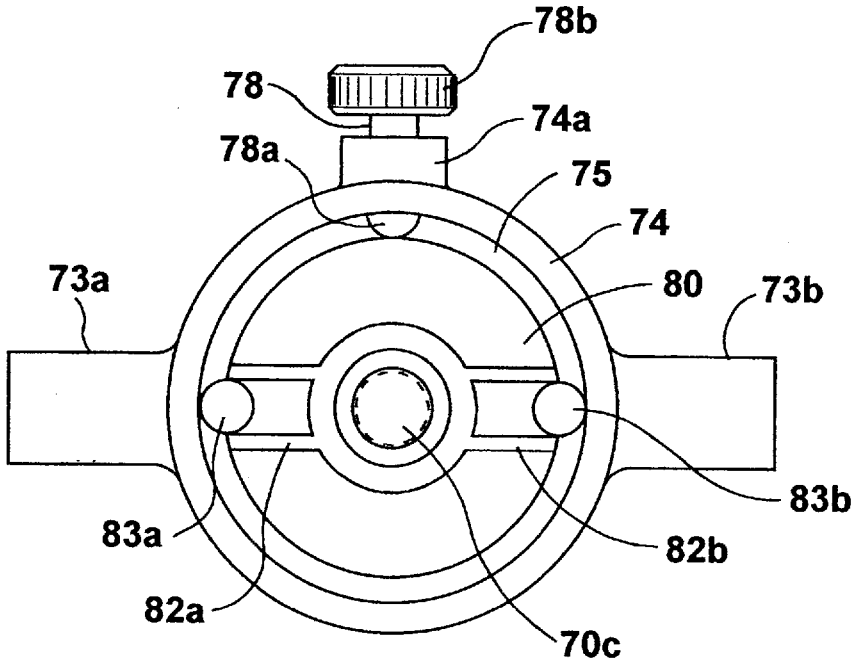
FIG. 2 is a top plan view of the sprinkler of FIG. 1 with the cover removed.
Figure 3:
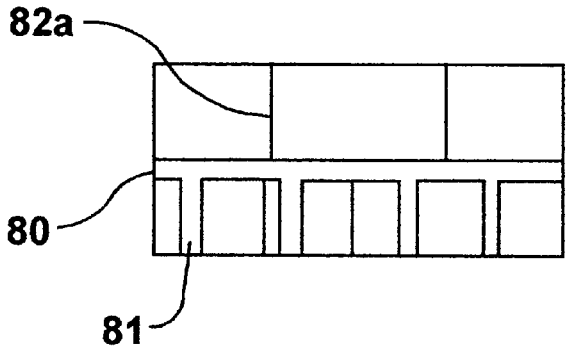
FIGS. 3, 4 and 5 are side, top and bottom views, respectively, of the rotary turbine disc included in the rotary sprinkler of FIGS. 1 and 2.
Figure 4:
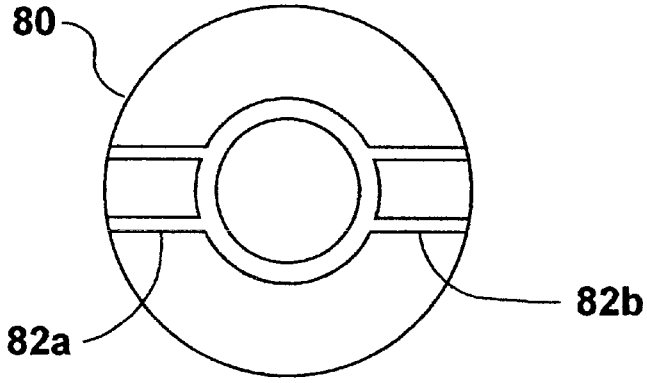

As shown in FIG. 2, annular wall 74 is integrally formed with a short sleeve 74*a* receiving a radially-extending pin 78, such that the inner end 78*a* of pin 78 projects into chamber 75 and serves as an abutment which is impacted in order to rotate the water discharge assembly 70. The outer end 78*b* of pin 78 is accessible for adjusting the position of the inner end 78*a* within annular chamber 75.

The hollow interior of stem 70 serves as a connecting passageway for the water flowing from the inlet 62 to the water discharge nozzles 73*a*, 73*b*. Accordingly, stem 70 is formed with a pair of outlet openings 79*a*, 79*b* aligned with the water discharge nozzle 73*a*, 73*b*.

Figure 5:
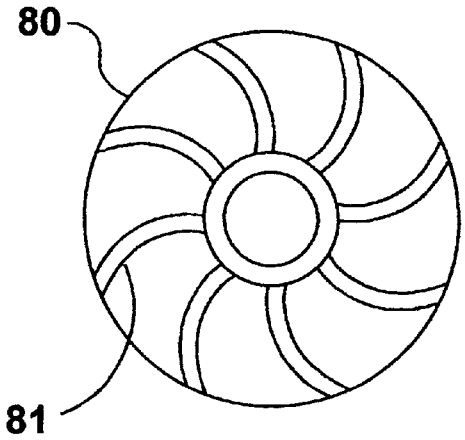

The drive 8 for rotating the water discharge assembly 7 includes a rotary turbine disc 80 rotatably supported on the outer end of stem 70. Disc 80 is formed on one face (the bottom face as shown particularly in FIG. 5), with a plurality of vanes 81 aligned with and interposed between the stem outlet opening 79*a*, 79*b* and the water discharge nozzles 73*a*, 73*b*. The opposite face of turbine disc 80 is formed with a pair of radially-extending diametrically-aligned channels or passageways 82*a*, 82*b*, each for receiving a ball 83*a*, 83*b*.

The sprinkler illustrated in the drawings operates as follows:

Pressurized water applied via inlet 62 flows through the connecting passageway defined by the hollow stem 70 to the outlet openings 79*a*, 79*b* in the hollow stem aligned with the water discharge nozzles 73*a*, 73*b* of the water discharge assembly 7. Before the water reaches the water discharge nozzles 73*a*, 73*b*, however, the water impinges the vanes 81 of turbine disc 80 to impart a high speed rotation to the turbine disc. This high speed rotation of the turbine disc causes the balls 83*a*, 83*b* on the opposite (upper) surface of the disc to move radially outwardly within channels 82*a*, 82*b* by centrifugal force and thereby to impact the abutment 78*a* defined by the inner end of threaded fastener 78. These repeated impacts of abutment 78 by balls 83*a*, 83*b* rotate the water discharge assembly 7, including its nozzles 73*a*, 73*b*, in short steps or increments as the nozzles discharge the water laterally of the sprinkler.

It will thus be seen that the water flowing from the inlet 62 to the nozzles 73*a*, 73*b* does not come into contact with the balls 83*a*, 83*b* which produce the stepped rotation of the sprinkler. Accordingly, the balls do not impose a resistance to the flow of the water to the discharge nozzles 73*a*, 73*b*. In addition, dirt particles within the water do not come into contact with the balls producing the stepped rotation, or with the channels 82*a*, 82*b* in which the balls move, and therefore there is less possibility that dirt particles within the water will tend to jam the rotation of the sprinkler. Any dirt that may accumulate within the ball chamber 75 may be easily cleaned by merely removing cover 76.

A further important feature in the illustrated construction is that the sprinkler will produce a scattered-jet discharge, rather than a combined jet discharge. A scattered-jet discharge is highly desirable in many applications of such sprinklers, such as for irrigating banana and other fruit trees. Since the vanes 81 of the turbine disc 80 are in alignment with, and interposed between, the outlet openings 79*a*, 79*b* of the stem 70, and the two water discharge nozzles 73*a*, 73*b*, these vanes will effectively break up the water flowing into the water discharge nozzles, and thereby produce a scattered pattern.

A still further advantage in the sprinkler illustrated is that it is constructed of but a few simple parts which can be produced and assembled in volume and at low cost, which can be conveniently disassembled for repair or maintenance purposes.

While the invention has been described with respect to one preferred embodiment, it will be appreciated that this is set forth merely for purposes of example, and that many changes may be made. For example, the illustrated sprinkler could include but a single nozzle, or simple water discharge openings instead of nozzles. In addition, the turbine disc 80 could support a single ball or a plurality of pairs of balls, according to the particular application. Many other variations, modifications and applications of the invention will be apparent.

What is claimed is:

1. A rotary sprinkler, comprising:

a mounting member having an inlet connectible to a water supply pipe supplying pressurized water;

a water discharge assembly rotatably carried by said mounting member, said water discharge assembly including at least one water discharge outlet for discharging water laterally of the sprinkler, and a connecting passageway fluidly coupling said inlet to said water discharge outlet;

and a drive for rotating said water discharge assembly, said drive including a rotary turbine in said connecting passageway rotated by the water flow therethrough from said inlet to said water discharge outlet;

said rotary turbine including vanes located at the end of said connecting passageway adjacent to and in alignment with said water discharge outlet and said end of the connecting passageway such that said vanes break up the water flow into said water discharge outlet to produce a scattered discharge therefrom.

2. The sprinkler according to claim 1, wherein said rotary drive includes at least one ball carried by said rotary turbine and movable radially outwardly thereof by centrifical force during the rotation of said rotary turbine;

said water discharge assembly further including an abutment located to be impacted by said ball when in its radial outward position during the rotation of said rotary turbine to thereby rotate the water discharge assembly in a series of stepped increments during the rotation of said rotary turbine.

3. The sprinkler according to claim 2, wherein said rotary turbine includes a disc formed with said vanes on one face, and with a radial passageway on its opposite face for receiving said ball.

4. The sprinkler according to claim 3, wherein said water discharge assembly further includes a stem rotatably mounted to said mounting member; said stem being hollow to define said connecting passageway, and being formed with an outlet opening aligned with said water discharge opening; said rotary turbine disc being rotatably supported on said stem with said vanes aligned with and interposed between said stem outlet opening and said water discharge opening.

5. The sprinkler according to claim 4, wherein said water discharge assembly further includes a cover fixed to one end of said stem to overlie and cover said opposite face of the rotary turbine disc.

6. The sprinkler according to claim 5, wherein a sealing ring is carried by said stem for sealing the stem with respect to its rotatable mounting in said mounting member.

7. The sprinkler according to claim 4, wherein said drive includes two balls, and said opposite face of the rotary turbine disc is formed with two diametrically-aligned radially-extending passageways for receiving said two balls.

8. The sprinkler according to claim 4, wherein said water discharge opening is in the form of a nozzle integrally formed with said stem.

9. The sprinkler according to claim 8, wherein said water discharge assembly further includes an annular wall integrally formed with said nozzle and said stem and enclosing said opposite face of the rotary turbine disc, said impacted abutment being constituted of a pin threaded radially through said annular wall.

10. The sprinkler according to claim 8, wherein said water discharge assembly includes two water discharge openings in the form of diametrically-aligned nozzles integrally formed with said stem.

11. A rotary sprinkler, comprising:

a mounting member having an inlet connectible to a water supply pipe supplying pressurized water;

a water discharge assembly rotatably carried by said mounting member, said water discharge assembly including two water discharge outlets for discharging water laterally of the sprinkler, and a connecting passageway fluidly coupling said inlet to each of said water discharge outlets;

and a drive for rotating said water discharge assembly, said drive including a rotary turbine in said connecting passageway rotated by the water flow therethrough from said inlet to said water discharge outlet, and two balls carried by said rotary turbine and movable radially outwardly thereof by centrifugal force during the rotation of said rotary turbine;

said water discharge assembly further including an abutment for, and located to be impacted by, each of said balls when in its radial outward position during the rotation of said rotary turbine to thereby rotate the water discharge assembly in a series of stepped increments during the rotation of said rotary turbine;

said rotary turbine including a disk formed with vanes on one face, and with a radial passageway on its opposite face for each of said balls.

12. The sprinkler according to claim 11, wherein said vanes are located at the end of each of said connecting passageways adjacent to the respective water discharge outlet such that said vanes break up the water flow into the water discharge outlets to produce a scattered discharge therefrom.

13. The sprinkler according to claim 11, wherein said water discharge assembly further includes a stem rotatably mounted to said mounting member; said stem being hollow to define said connecting passageways, and being formed with an outlet opening aligned with each of said water discharge openings;

said rotary turbine disc being rotatably supported on said stem with said vanes aligned with and interposed between said stem outlet openings and said water discharge openings.

14. The sprinkler according to claim 13, wherein said water discharge assembly further includes a cover fixed to one end of said stem to overlie and cover said opposite face of the rotary turbine disc.

15. The sprinkler according to claim 13, wherein a sealing ring is carried by said stem for sealing the stem with respect to its rotatable mounting in said mounting member.

16. The sprinkler according to claim 13, wherein said passageways formed in said opposite face of the rotary turbine disc for receiving said balls are diametrically-aligned radially-extending passageways.

17. The sprinkler according to claim 13, wherein said water discharge openings are nozzles integrally formed with said stem.

18. The sprinkler according to claim 17, wherein said water discharge assembly further includes an annular wall integrally formed with said nozzles and said stem and enclosing said opposite face of the rotary turbine disc, said impacted abutments being constituted of a pin threaded radially through said annular wall.

* * * * *